US009346608B2

(12) United States Patent
Sublett

(10) Patent No.: US 9,346,608 B2
(45) Date of Patent: May 24, 2016

(54) CHAIN SAW-CHAIN RETAINING DEVICE AND ORGANIZER

(76) Inventor: E. L. Sublett, Ennis, TX (US)

( * ) Notice: Subject to any disclaimer, the term of this patent is extended or adjusted under 35 U.S.C. 154(b) by 0 days.

(21) Appl. No.: 13/442,710

(22) Filed: Apr. 9, 2012

(65) Prior Publication Data

US 2013/0264236 A1 Oct. 10, 2013

(51) Int. Cl.

| | |
|---|---|
| ***A45C 11/26*** | (2006.01) |
| ***B65D 85/00*** | (2006.01) |
| ***B27B 17/00*** | (2006.01) |
| ***B65D 73/00*** | (2006.01) |
| *B65D 51/20* | (2006.01) |

(52) U.S. Cl.

CPC ..... *B65D 85/00* (2013.01); *B27B 17/00* (2013.01); *B65D 73/0014* (2013.01); *B65D 51/20* (2013.01)

(58) Field of Classification Search

CPC B27B 17/0008; Y10S 269/902; B23Q 13/00; B25H 3/003; B25H 3/04; B25H 3/06; B25H 3/006; B65D 2201/00; B65D 88/00

USPC ..... 220/349; 342/160.4; 30/384–387, 381, 30/383; 43/20; 16/204, 195, 213; 248/310, 248/307; 81/491, 464, 486; D8/65; 211/70, 211/70.6, 70.8; 123/41.46; 198/303, 813

See application file for complete search history.

(56) References Cited

U.S. PATENT DOCUMENTS

| | | | | |
|---|---|---|---|---|
| 757,178 | A * | 4/1904 | Cross | 49/102 |
| 1,281,261 | A * | 10/1918 | Andreas. | 242/270 |
| 1,773,059 | A * | 8/1930 | Ohno | 16/194 |
| 2,765,821 | A * | 10/1956 | Strunk | 30/386 |
| 3,194,284 | A * | 7/1965 | Walker | 30/386 |
| 3,636,995 | A * | 1/1972 | Newman | 30/386 |
| 4,428,139 | A * | 1/1984 | Henze et al. | 43/20 |
| 4,805,889 | A * | 2/1989 | Liepse | 269/210 |
| 4,905,948 | A * | 3/1990 | Indorf | 248/309.1 |
| 5,491,899 | A * | 2/1996 | Schliemann et al. | 30/386 |
| 6,012,571 | A * | 1/2000 | LaPierre | 206/6.1 |
| 7,322,114 | B2 * | 1/2008 | Kawamura | 30/386 |
| 7,624,862 | B1 * | 12/2009 | Pleggenkuhle | 206/349 |
| 7,905,354 | B1 * | 3/2011 | Geibel | 206/378 |
| 2001/0001197 | A1 * | 5/2001 | Ramsey et al. | 206/378 |

FOREIGN PATENT DOCUMENTS

WO WO 9301104 A1 * 1/1993

* cited by examiner

*Primary Examiner* — Anthony Stashick
*Assistant Examiner* — James M Van Buskirk

(57) ABSTRACT

A chain retaining device to retain a chain may include a chain mounting section to mount the chain and a handle section being connected to the chain mounting section to carry the chain retaining device. The chain mounting section may include a detachably connected chain holding device to adjust to different sizes chains. The chain holding device may be adapted form a friction connection to the chain mounting section. The chain holding device may include a handle to form the friction connection.

6 Claims, 3 Drawing Sheets

CHAIN SAW-CHAIN RETAINING DEVICE AND ORGANIZER

FIELD OF THE INVENTION

The present invention provides for the storage of chain saw chains and more particularly for a chain retaining device and organizer.

BACKGROUND

A chain saw includes a motor and a guide bar which includes two guide plates and a spacer plate which is sandwiched between the two guide plates. The guide bar usually is made by metal, and a groove is defined along a periphery of the guide bar so as to receive the chain therein.

The chainsaw may wear out the chain or the chainsaw may require a different chain in order to achieve a different cut. In order to accomplish this, the chain needs to be stored while the chain is off the chainsaw. The storage of the chain should maintain a tension on the chain in order to prevent the chain from becoming tangled.

SUMMARY

A chain retaining device to retain a chain may include a chain mounting section to mount the chain and a handle section being connected to the chain mounting section to carry the chain retaining device. The chain mounting section may include a detachably connected chain holding device to adjust to different sizes chains.

The chain holding device may be adapted to form a friction connection to the chain mounting section.

The chain holding device may include a handle to form the friction connection.

The chain holding device may include a grooved cylinder connected to the handle to receive the chain.

The chain holding device may include a fastener to cooperate with the back surface of the chain mounting section.

The fastener may be a bolt.

The chain holding device may cooperate with a common chain holding device to hold the chain.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

Figure 1:
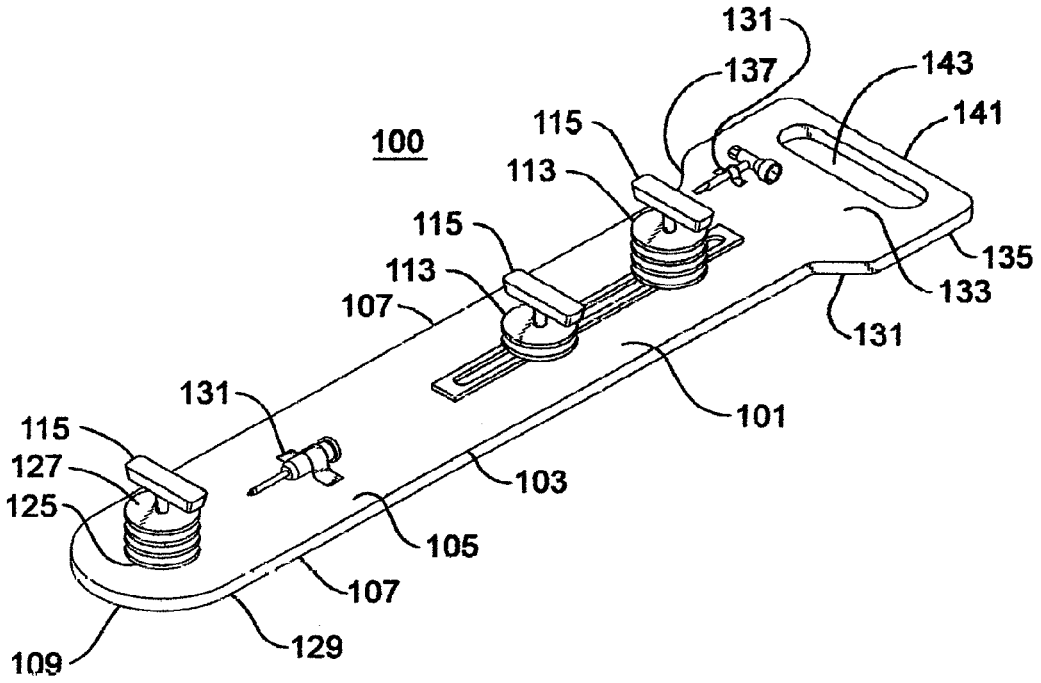
FIG. 1 illustrates a perspective view of a chain retaining device of the present invention.

The present invention provides for the storage of chains while not mounted on the chainsaw. The present invention prevents the chain from becoming tangled and can easily be placed on the chainsaw when it is required. FIG. 1 illustrates a perspective view of the chain retaining device 100 of the present invention which may include a mounting platform 101 which may be rigid and maybe formed from wood, plastic, metal, a combination of wood, plastic, metal or other appropriate materials. The mounting platform 101 may include a chain mounting section 103 to mount a retaining chain such as the chain for a chainsaw and a handle section 115 to allow the chain retaining device 100 to be easily transported from a first location to a second location. The chain mounting section 103 may include a planar top retaining surface 105 which may be connected to a pair of opposing side retaining surfaces 107 at the periphery of the top retaining surface 105 and which may be connected to a first end retaining surface 109 which may be convexly curved. The chain mounting section 103 may include a longitudinal slot 111 which may extend completely through the chain mounting section 103 and may extend in the longitudinal direction of the chain mounting section 103. The longitudinal slot 111 may cooperate with a single chain holding device 113 or multiple chain holding devices 113 which may be slidably connected to the chain mounting section 103 to adjustably slide within the longitudinal slot 111 in order to accommodate different lengths of chain and may be fixed at a specific position in order to hold the chain taut.

The chain holding device 113 may include a handle 115 which may be rotated in order to rotate a shaft 117 which may be threadably connected to a fastener 119 which may be a bolt which may be tightened in order to secure the chain holding device 113 against the chain mounting section 103 once the chain holding device 113 has been placed at a desired location.

In addition, the chain holding device 113 may include a cylinder 121 which may be connected to the handle 115, and the shaft 117 may extend through the cylinder 121 which may include a channel 123 which may extend radially around the periphery of the cylinder 121 and which the chain may be placed into the channel 123.

A common chain holding device 127 may be positioned at an opposed end of the chain mounting section 103 and may cooperate with an aperture 125 which may extend through the chain mounting section 103. The common chain holding device 127 and the chain holding device 113 may include multiple cylinders 127; each having the channel 123 to hold multiple chains.

The chain mounting section 103 may include a planar bottom retaining surface 129 which may be opposed to the top retaining surface 105 and may be connected to the first end retaining surface 109 and the side retaining surface 107. The chain mounting section 103 may include fastening devices 131 which may be a flexible strap in order to hold down various tools to be used with the chain retaining device 100.

The chain mounting section 103 may be integral with and connected to the handle section 105 which may include a top handle surface 133 which may be opposed to a bottom handle surface 135, and the top handle surface 133 and the bottom handle surface 135 may be connected to an inclined side surface 137 which may be connected to the side retaining surface 107 and which may be inclined or angled with respect to the side retaining surface 107. The inclined side surface 137 may be connected to the side handle surface 139 which may be substantially parallel to the side retaining surface 107. The side handle surface 139 may be connected to the second end handle surface 141, and the handle section 105 may include a traverse slot 143 which may extend through the handle section 105 and may be sufficiently large in order to accommodate the fingers of the user in order to transport the chain retaining device.

In operation, a chain is placed around the common chain holding device 127, and the opposing end of the chain is placed around one of the chain holding device 113. The chain holding device 113 is adjustably slid through the slot 111 until the chain is taut, and the user rotates the handle 115 in order to cooperate with the fastener 119 to achieve a friction fit with the chain mounting section 103. When the chain is needed elsewhere, the user rotates the handle 115 in the opposite direction to loosen the fastener 119 and the friction fit with the chain mounting section 103. The chain is removed.

Figure 5:
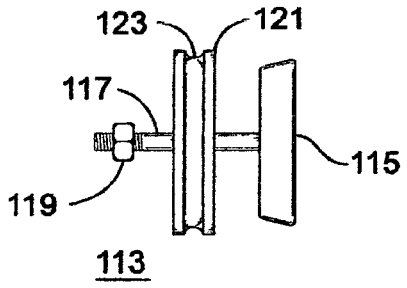
FIG. 5 illustrates a side view of the chain holding device of the present invention.

FIG. 5 illustrates a side view of the chain holding device 113 which may include a cylinder 121 and which may be connected to the handle 115, and the shaft 117 may extend through the cylinder 121 which may include a channel 123 which may extend radially around the periphery of the cylinder 121 and which the chain may be placed into the channel 123.

The chain holding device 113 may include a handle 115 which may be rotated in order to rotate a shaft 117 which may be threadably connected to a fastener 119 which may be a bolt which may be tightened in order to secure the chain holding device 113 against the chain mounting section 103 once the chain holding device 113 has been placed at a desired location.

Figure 6:
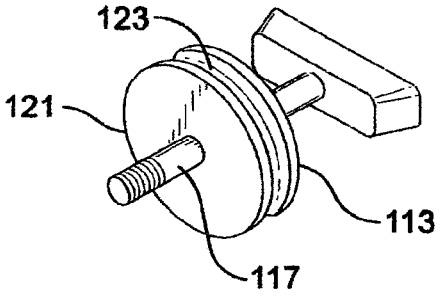
FIG. 6 illustrates a perspective view of the cylinder of the chain holding device of the present invention.

FIG. 6 illustrates a perspective view of the cylinder 121 which may include a channel 123 which may extend radially around the periphery of the cylinder 121 and which the chain may be placed into the channel 123.

Figure 2:
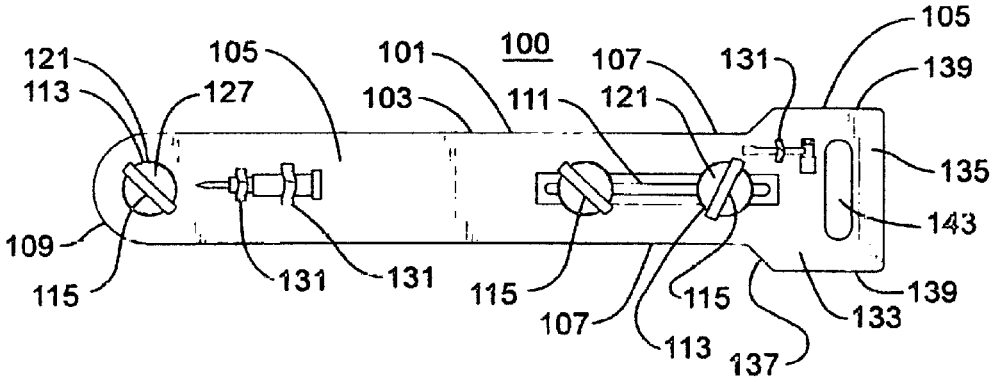
FIG. 2 illustrates a top view of the chain retaining device of the present invention.

FIG. 2 illustrates a top view of the chain retaining device 100 of the present invention which may include a mounting platform 101 which may be rigid and maybe formed from wood, plastic, metal, a combination of wood, plastic, metal or other appropriate materials. The mounting platform 101 may include a chain mounting section 103 to mount a retaining chain such as the chain for a chainsaw and a handle section 105 to allow the chain retaining device 100 to be easily transported from a first location to a second location. The chain mounting section 103 may include a planar top retaining surface 105 which may be connected to a pair of opposing side retaining surfaces 107 at the periphery of the top retaining surface 105 and which may be connected to a first end retaining surface 109 which may be convexly curved. The chain mounting section 103 may include a longitudinal slot 111 which may extend completely through the chain mounting section 103 and may extend in the longitudinal direction of the chain mounting section 103. The longitudinal slot 111 may cooperate with a single chain holding device 113 or multiple chain holding devices 113 which may be slidably connected to the chain mounting section 103 to adjustably slide within the longitudinal slot 111 in order to accommodate different lengths of chain and may be fixed at a specific position in order to hold the chain taut.

The chain holding device 113 may include a handle 115 which may be rotated in order to rotate a shaft 117 which may be threadably connected to a fastener 119 which may be a bolt which may be tightened in order to secure the chain holding device 113 against the chain mounting section 103 once the chain holding device 113 has been placed at a desired location.

In addition, the chain holding device 113 may include a cylinder 121 which may be connected to the handle 115, and the shaft 117 may extend through the cylinder 121 which may include a channel 123 which may extend radially around the periphery of the cylinder 121 and which the chain may be placed into the channel 123.

A common chain holding device 127 may be positioned at an opposed end of the chain mounting section 103 and may cooperate with an aperture 125 which may extend through the chain mounting section 103. The common chain holding device 127 and the chain holding device 113 may include multiple cylinders 127; each having the channel 123 to hold multiple chains.

The chain mounting section 103 may include a planar bottom retaining surface 129 which may be opposed to the top retaining surface 105 and may be connected to the first end retaining surface 109 and the side retaining surface 107. The chain mounting section 103 may include fastening devices 131 which may be a flexible strap in order to hold down various tools to be used with the chain retaining device 100.

The chain mounting section 103 may be integral with and connected to the handle section 105 which may include a top handle surface 133 which may be opposed to a bottom handle surface 135, and the top handle surface 133 and the bottom handle surface 135 may be connected to an inclined side surface 137 which may be connected to the side retaining surface 107 and which may be inclined or angled with respect to the side retaining surface 107. The inclined side surface 137 may be connected to the side handle surface 139 which may be substantially parallel to the side retaining surface 107. The side handle surface 139 may be connected to the second end handle surface 141, and the handle section 105 may include a traverse slot 143 which may extend through the handle section 105 and may be sufficiently large in order to accommodate the fingers of the user in order to transport the chain retaining device.

Figure 3:
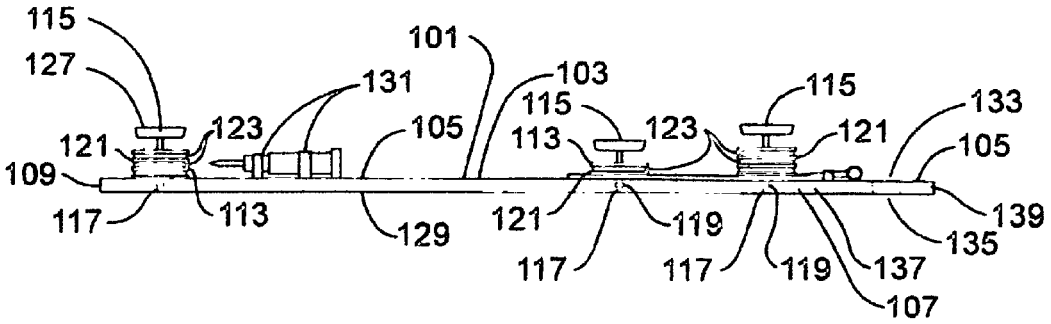
FIG. 3 illustrates a side view of the chain retaining device of the present invention.

FIG. 3 illustrates a side view of the chain retaining device 100 of the present invention which may include a mounting platform 101 which may be rigid and maybe formed from wood, plastic, metal, a combination of wood, plastic, metal or other appropriate materials. The mounting platform 101 may include a chain mounting section 103 to mount a retaining chain such as the chain for a chainsaw and a handle section 105 to allow the chain retaining device 100 to be easily transported from a first location to a second location. The chain mounting section 103 may include a planar top retaining surface 105 which may be connected to a pair of opposing side retaining surfaces 107 at the periphery of the top retaining surface 105 and which may be connected to a first end retaining surface 109 which may be convexly curved. The chain mounting section 103 may include a longitudinal slot 111 which may extend completely through the chain mounting section 103 and may extend in the longitudinal direction of the chain mounting section 103. The longitudinal slot 111 may cooperate with a single chain holding device 113 or multiple chain holding devices 113 which may be slidably connected to the chain mounting section 103 to adjustably slide within the longitudinal slot 111 in order to accommodate different lengths of chain and may be fixed at a specific position in order to hold the chain taut.

The chain holding device 113 may include a handle 115 which may be rotated in order to rotate a shaft 117 which may be threadably connected to a fastener 119 which may be a bolt which may be tightened in order to secure the chain holding device 113 against the chain mounting section 103 once the chain holding device 113 has been placed at a desired location.

In addition, the chain holding device 113 may include a cylinder 121 which may be connected to the handle 115, and the shaft 117 may extend through the cylinder 121 which may include a channel 123 which may extend radially around the periphery of the cylinder 121 and which the chain may be placed into the channel 123.

A common chain holding device 127 may be positioned at an opposed end of the chain mounting section 103 and may cooperate with an aperture 125 which may extend through the chain mounting section 103. The common chain holding device 127 and the chain holding device 113 may include multiple cylinders 127; each having the channel 123 to hold multiple chains.

The chain mounting section 103 may include a planar bottom retaining surface 129 which may be opposed to the top retaining surface 105 and may be connected to the first end retaining surface 109 and the side retaining surface 107. The chain mounting section 103 may include fastening devices 131 which may be a flexible strap in order to hold down various tools to be used with the chain retaining device 100.

The chain mounting section 103 may be integral with and connected to the handle section 105 which may include a top handle surface 133 which may be opposed to a bottom handle surface 135, and the top handle surface 133 and the bottom handle surface 135 may be connected to an inclined side surface 137 which may be connected to the side retaining surface 107 and which may be inclined or angled with respect to the side retaining surface 107. The inclined side surface 137 may be connected to the side handle surface 139 which may be substantially parallel to the side retaining surface 107. The side handle surface 139 may be connected to the second end handle surface 141, and the handle section 105 may include a traverse slot 143 which may extend through the handle section 105 and may be sufficiently large in order to accommodate the fingers of the user in order to transport the chain retaining device.

Figure 4:
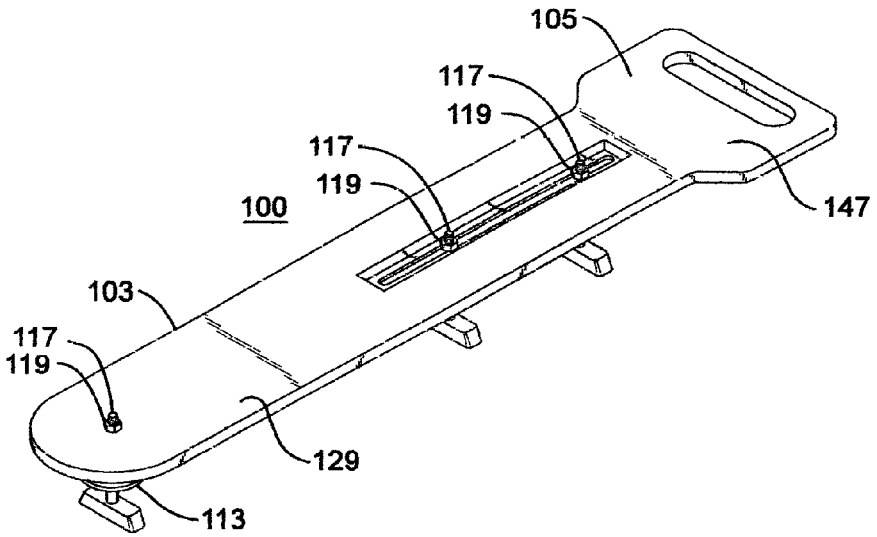
FIG. 4 illustrates a bottom view of the chain retaining device of the present invention.

FIG. 4 illustrates a bottom view of the chain retaining device 100 and illustrates the chain mounting section 103 and the handle section 105. FIG. 4 additionally illustrates the slot 111 and the fastener 119 and shaft 117 of the chain holding device 113 and illustrates the bottom retaining surface 129 and the bottom handle surface 147.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

The invention claimed is:

1. A chain retaining device to retain multiple chain saw-chains, comprising:

a multiple chain mounting section to simultaneously mount the multiple chain saw-chains of different lengths;

a handle section being connected to the chain mounting section to carry the chain retaining device wherein the chain mounting section includes at least two detachably connected chain holding devices to slidably adjust to different sizes chain saw-chains;

wherein the chain retaining device includes a cylinder having a radial channel configured to accept a chain saw-chain and a handle to secure the at least one of the chain holding devices against the chain mounting section.

2. A chain retaining device to retain a chain saw-chain as in claim 1, wherein the chain holding device is adapted to form a friction connection to the chain mounting section.

3. A chain retaining device to retain a chain saw-chain as in claim 2, wherein the chain holding device includes a handle to form the friction connection.

4. A chain retaining device to retain a chain saw-chain as in claim 1, wherein the chain holding device includes a fastener to cooperate with the back surface of the chain mounting section.

5. A chain retaining device to retain a chain saw-chain as in claim 4, wherein the fastener is a bolt.

6. A chain retaining device to retain a chain saw-chain as in claim 1, wherein the chain holding device cooperates with a common chain holding device to hold the multiple chain saw-chains.

* * * * *